United States Patent [19]

Kucheck

[11] Patent Number: 4,685,982

[45] Date of Patent: Aug. 11, 1987

[54] METHOD AND APPARATUS FOR SENSING SHEET-LIKE ELEMENTS

[75] Inventor: Leo Kucheck, Irvine, Calif.

[73] Assignee: Label-Aire Inc., Fullerton, Calif.

[21] Appl. No.: 718,960

[22] Filed: Apr. 2, 1985

[51] Int. Cl.[4] ..... G06M 3/02

[52] U.S. Cl. ..... 156/64; 156/361; 156/542; 250/571; 250/223 R

[58] Field of Search ..... 250/223 R, 571; 156/542, 361-363, 64, 344, 584; 226/95

[56] References Cited

U.S. PATENT DOCUMENTS

| | | | |
|---|---|---|---|
| 3,125,265 | 3/1964 | Warren et al. | 226/95 X |
| 3,396,280 | 8/1968 | Knudsen | 250/223 R |
| 3,493,693 | 2/1970 | Balint | 226/95 X |
| 3,529,168 | 9/1970 | Guggisberg | 250/223 R |
| 3,531,650 | 9/1970 | Cronin | 250/571 |
| 3,586,866 | 6/1971 | Kawata | 250/223 R X |
| 3,619,578 | 11/1971 | George | 250/223 R X |
| 4,288,272 | 9/1981 | Pfeffer | 156/361 |
| 4,319,847 | 3/1982 | Howarth | 250/571 X |
| 4,417,148 | 11/1983 | Otake | 250/223 R X |

*Primary Examiner*—David Simmons

*Attorney, Agent, or Firm*—Gordon L. Peterson

[57] ABSTRACT

An apparatus for use with a label strip or the like which includes an elongated web and a plurality of labels with the labels being on the web and being separated by a gap. The label strip is moved through a label sensing station, and light is directed toward the label strip at the label sensing station so that the light impinges sequentially on the labels and the web in the gaps. The light is directed against the label strip at an acute angle of incidence which is sufficiently small so that an optical signal is reflected from the web in the gap at the sensing station. The optical signal is detected to indicate the presence of the gap at the sensing station. A barrier cooperates with the labels to block light other than the optical signal from being conducted from the light source to the detector.

8 Claims, 10 Drawing Figures

AIR
PRESSURE
START M 13
25
63
65
57
77
75
93
79
91
89
67
59
73
69
81
83
101
99
55
57
33
29
61
35

53
57
29
25
47
49
57
33
55
101
99
31
29

57
29
25
53
51
47
49
A
57
101
55
48
33
31
29
99

METHOD AND APPARATUS FOR SENSING SHEET-LIKE ELEMENTS

BACKGROUND OF THE INVENTION

One common form of label applicator applies labels from a label strip to articles as the articles pass through a labeling station. The label strip includes a web or backing strip, and the labels which are spaced apart by a gap are removably adhesively secured to the backing strip. The label applicator removes the labels from the backing strip and transfers them to the articles at the labeling station.

More particularly, the label strip is indexed or moved intermittently during operation of the label applicator with each indexing movement of the label strip resulting in the removal of a label from the web and the transfer of that label, or a previously removed label, to the article at the labeling station. The stop signal for the label strip is typically, optically derived by directing light perpendicular to the plane of the label strip at a sensing station toward a photocell or other light receiver. In many cases, the labels transmit a relatively low percent of light, and the web transmits a higher percentage of light. Accordingly, there is a difference in intensity of the light received by the photocell, and this can be used to indicate the presence of each of the gaps at the sensing station.

Although such a label-sensing system works well for labels having relatively low light transmission characteristics, it cannot sense transparent labels or opaque labels on an opaque web. Various attempts have been made to sense labels in these situations, but each of them has drawbacks. For example, the web may be provided with an opaque spot or a hole which can be detected. However, these added operations increase the cost of the label strip as does the addition of a special ultraviolet opaque coating on the label adhesive. A rotating star wheel can be used to detect the thickness difference between the label-web combination and the web alone; however, this mechanism is speed-limited and cannot be used when rapid labeling is required.

SUMMARY OF THE INVENTION

This invention solves these problems by providing a detection system which can optically detect transparent, as well as opaque labels. With this invention, light is directed from a source toward the label strip at the sensing station so that the light impinges sequentially on the labels and the web at gaps. At least some of the light is conducted through at least a portion of the gap at the sensing station to thereby provide an optical signal indicative of the presence of the gap at the sensing station. However, unlike prior art sensing systems, the optical signal does not pass through the web at the gap. The optical signal can be optically detected by a detector.

Barrier means is used for reducing the conduction of light from the light-directing means to the detector when light is directed toward the labels rather than in the gap between labels. This reduction is sufficient so that the optical signal has a greater intensity than other light from the light source which might reach the detector when no gap is at the sensing station. The differential intensity is sufficient so that the optical signal, which indicates the presence of a gap at the sensing station, can be readily detected by the detector.

Light can be directed into the gap in various ways to enable label sensing in accordance with this invention. For example, the light-directing means may lie along one longitudinal edge of the label and direct light through the gap longitudinally of, or parallel to, the gap and perpendicular to the direction of motion of the label strip. The optical signal is transmitted through the gap and received along the opposite longitudinal edge of the label. When this technique is used, the barrier should include a barrier wall that extends across the gap at the sensing station and cooperates with the labels which are spaced apart by such gap.

Although such a label sensor can be used, it is somewhat difficult to transmit light completely longitudinally through a gap of extremely small cross-sectional dimensions. In this regard, the gap may have cross-sectional dimensions of, for example, 0.0015 inch in depth by $\frac{1}{8}$ inch in width. In addition, the light-directing means and the detector should be placed along the longitudinal edges of the label in close proximity to the gap, and for this reason, it would be necessary or desirable to adjust the position of the light-directing means and the detector for labels of different width.

For these reasons, it is preferred, but not essential, to have the directing means direct the light against the label strip at an acute angle of incidence so that an optical signal is reflected from the web in the gap at the sensing station. This concept permits the light-directing means and light-receiving means for receiving the optical signal to be positioned along the outer face of the label, i.e., the face remote from the web, and no adjustments need to be made for labels of varying width. Also, it is relatively easy to direct light from the light-directing means into the gap and to receive the reflected signal.

With this technique, it is also desirable to employ barrier means cooperable with the labels to reduce light, other than the optical signal, from being conducted from the directing means to the detector. More specifically, the barrier means may include a barrier extending across the gap at the sensing station and cooperating with the labels for reducing the conduction of light reflected from the labels. Preferably, light is blocked sufficiently so that the light reaching the detector from the source when no gap is at the sensing station is negligible compared to the light reaching the detector when a gap is sensed. The angle of incidence of the light directed against the web at the gap must be sufficiently small so that the reflected optical signal can pass across or beneath the barrier means so that the optical signal can be received for detection.

The reflecting technique can be used even when the web is transparent. In this regard, reflection from a transparent surface is possible if the angle of incidence is sufficiently small.

The reflecting technique is particularly adapted for use with transparent labels; however, transparent labels present an additional problem. More specifically, when light is directed against a transparent label, the label would tend to transmit at least some of the light beneath or across the barrier means where it may be detected. To avoid the detection problems that this might create, it is preferred to direct the light against the label at an angle of incidence which is sufficiently small so that light entering the transparent label is essentially captured by substantially total internal reflection within the transparent label.

This invention also has advantages when compared with the conventional optical technique for sensing labels. For example, the sensitivity of the conventional sensor must be adjusted for label strips of different light-transmission characteristics. This is not necessary with the present invention. In addition, with the prior art optical technique, it is necessary to adjust the position of both the light source and the detector when either the leading edge or trailing edge of the label to be sensed is round. With this invention, the light-directing means and the detector can be moved as a single unit thereby simplifying the position adjustments required and also preventing misorientation of the light-directing means relative to the detector.

Although this invention is particularly applicable to the sensing of the labels of a label strip, in a broader sense, it is also applicable to the sensing of sheet-like elements arranged in a row and separated by a gap. The sheet-like elements may be coupled to a backing strip or web or they may be unattached to a moving surface, such as a conveyor belt, which transports them through a sensing station. For example, the sheet-like element may be silicon wafers.

The detector provides a signal indicating that the gap is at the sensing station, and a variety of functions can occur in response to such signal. For example, the labels can be counted and/or the signal can be used to terminate the indexing movement of the label strip.

In a preferred construction, a sensing block is provided which has a face that confronts the labels at the sensing station. The sensing block has a recess which opens at the face, and the barrier means includes a barrier wall carried by the sensing block and dividing the recess into first and second chambers. The light-directing means directs the light from the source into the first chamber and toward the label strip, and the reflected optical signal is received in the second chamber.

Another feature of this invention is directing air through ports in the face against the label strip. This holds the label strip against its supporting surface without scratching the label and serves, in effect, as a lubricant film which eliminates the usual hold-down leaf spring. In addition, the air blows away particles that would tend to move the sensing block and barrier wall away from the label strip which would cause a spurious optical signal.

Cooperating with the air under pressure is resilient means for resiliently urging the sensing block toward the label strip. The air film resists this resilient force, and consequently, the sensing block can glide smoothly on the air film.

The invention, together with additional features and advantages thereof, may best be understood by reference to the following description taken in connection with the accompanying illustrative drawing.

DESCRIPTION OF THE PREFERRED EMBODIMENT

Figure 1:
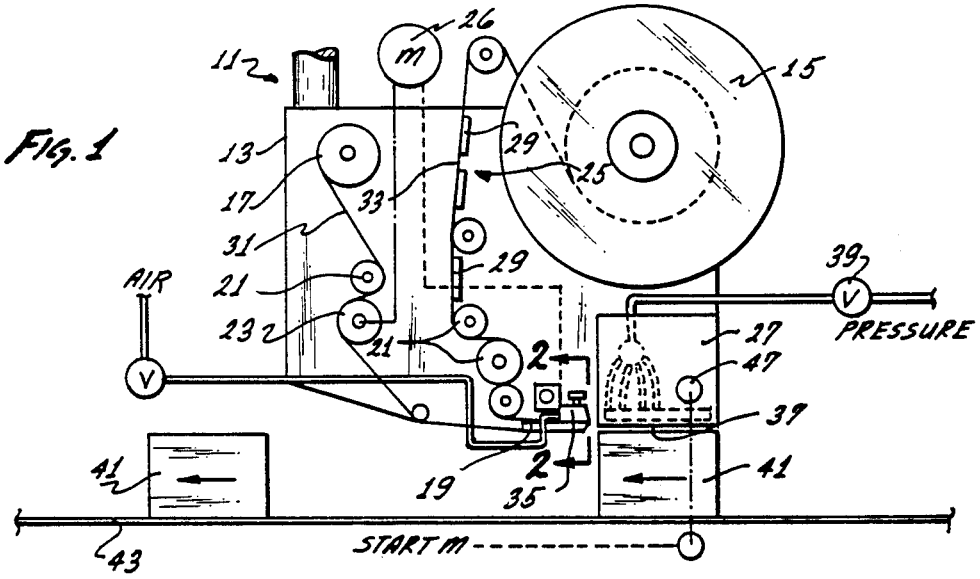
FIG. 1 is a schematic, side elevational view of a label applicator constructed in accordance with the teachings of this invention.

FIG. 1 shows by way of example a label applicator 11 which includes a supporting structure 13, a supply reel 15 and a take-up reel 17, both rotatably mounted on the supporting structure, a peeler bar 19 mounted on the supporting structure, rollers 21, including a drive roller 23 for moving a label strip 25 from the supply reel over the peeler bar to the take-up reel, a motor 26 for driving the drive roller, and a vacuum box 27. As shown in FIGS. 1 and 6, the label strip 25 includes labels 29 adhesively secured to a web 31 in a row and spaced apart by gaps 33.

The label applicator 11 also includes a sensing apparatus 35, and except for the sensing apparatus, the label applicator 11 may be conventional, and the form of label applicator shown is merely illustrative. Thus, the vacuum box 27 includes the usual air pervious grid 37 for receiving a label from the peeler bar 19. The vacuum box 27 is evacuated to a pressure less than atmospheric so that a suction force is applied through the grid to releasably retain the label. The vacuum box 27 is coupled via a valve 39 to a source of air under pressure.

Articles 41 to be labeled are moved past the label applicator 11 by a conveyor 43 in the direction of the arrows in FIG. 1, and their presence is detected in a conventional manner by a photocell 45 which is arranged to receive light from a light source 47, except when the light path is blocked by one of the articles 41.

Although the sequence of operation may vary, in one such known sequence, the label strip 25 is stationary, and a previously separated label 29 is retained on the grid 37 by vacuum pressure within the vacuum box 27. When one of the articles 41 interrupts the light beam from the light source 47 to the photocell 45, a signal is provided which opens the valve 39 for a short interval so that a momentary blast of air under pressure is supplied to the grid 37 to blow the label on the grid onto the article therebelow to label such article. In addition, this signal starts the motor 26 which drives the drive roller 23 to move the label strip 25 over the peeler bar 19 to remove another label 29 and provide it to the grid 37 where it is retained by vacuum pressure. When one label 29 has been removed from the web 31 in this manner, the sensing apparatus 35 provides a sensor signal to the motor 26 which stops movement of the label strip 25 until another article 41 is detected at the labeling station whereupon the above-described sequence is repeated.

Figure 6A:
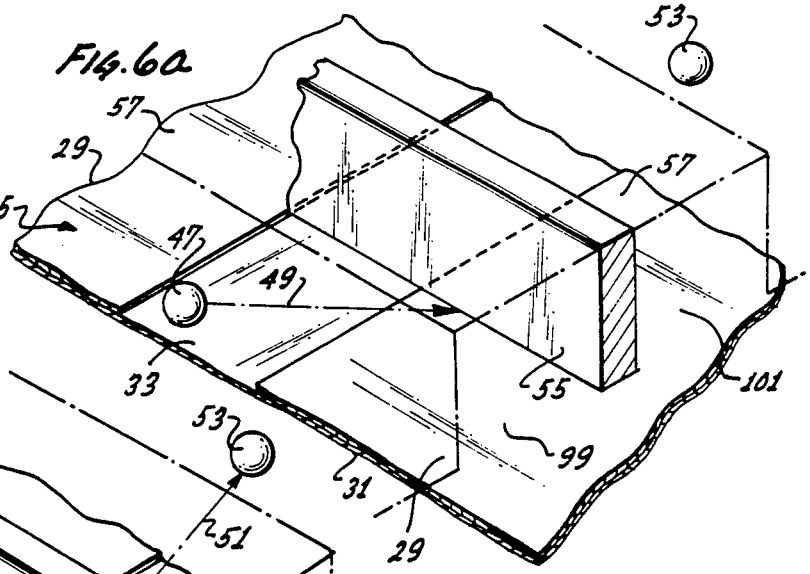
FIG. 6*a* is a view similar to FIG. 6 showing a label at the sensing station and with the light beam blocked.
Figure 6:
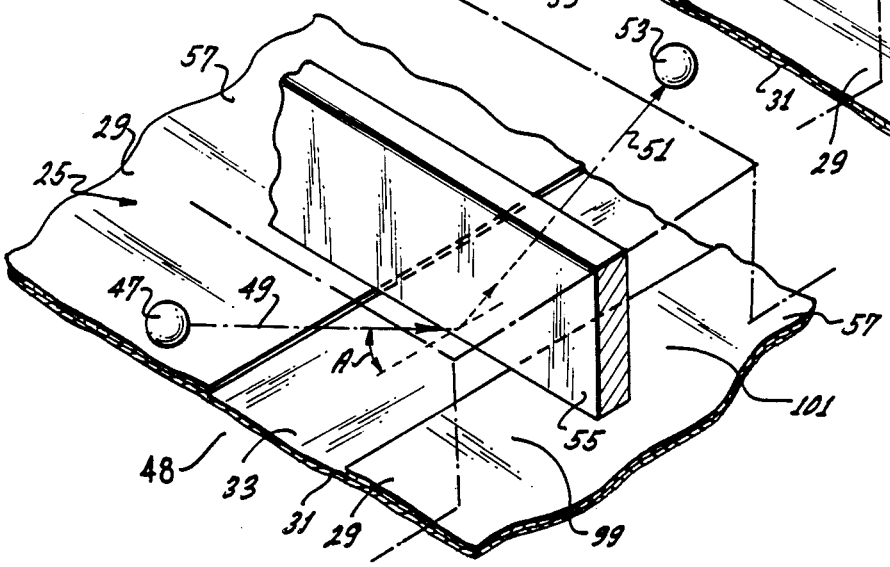
FIG. 6 is a schematic, isometric view illustrating the principal on which the optical sensing system of the preferred embodiment operates showing the detection of a gap at the sensing station, with the optical signal passing under the barrier.

The principal of operation of the sensing apparatus 35 shown in the illustrated embodiment can best be understood with reference to FIGS. 6 and 6*a*. The sensing apparatus 35 (FIG. 1) senses each of the gaps 33 (FIG.

6) between adjacent labels 29 at a sensing station 48 (FIG. 6). In this regard, the gap 33 has a very short height dimension represented by the vertical dimension in FIG. 6, and the grid dimension of the gap 33 is greatly exaggerated in FIG. 6 for clarity.

Light is directed from a source 47 against the label strip 25 so that the light impringes sequentially on the label 29 and the web 31 in the gaps 33 at the sensing station 48. The light is directed along an axis 49 to form an acute angle of incidence A so that an optical signal is reflected from the web 31 in the gap 33 at the sensing station along an axis 51 to a detector 53. To prevent the appearance of the optical signal at the detector 53 when a label 29 is at the sensing station and the gap 33 is not at the sensing station as shown in FIG. 6*a*, a barrier wall 55 extends across the gap 33 at the sensing station and cooperates with the labels 29 which are spaced apart by such gap. Specifically, the barrier wall 55 engages, or in the illustrated embodiment is spaced very slightly from, the outer faces 57 of these labels to essentially block light conduction from the source 47 to the detector 53. Of course, the source 47 and/or the detector 53 can be located remotely from the position shown in FIGS. 6 and 6*a*. For example, light could be conducted from a remote source and ultimately be directed below the axis 49 and reflected along the axis 51 to a receiver which would in turn conduct the optical signal from a remotely located detector.

Figure 5:
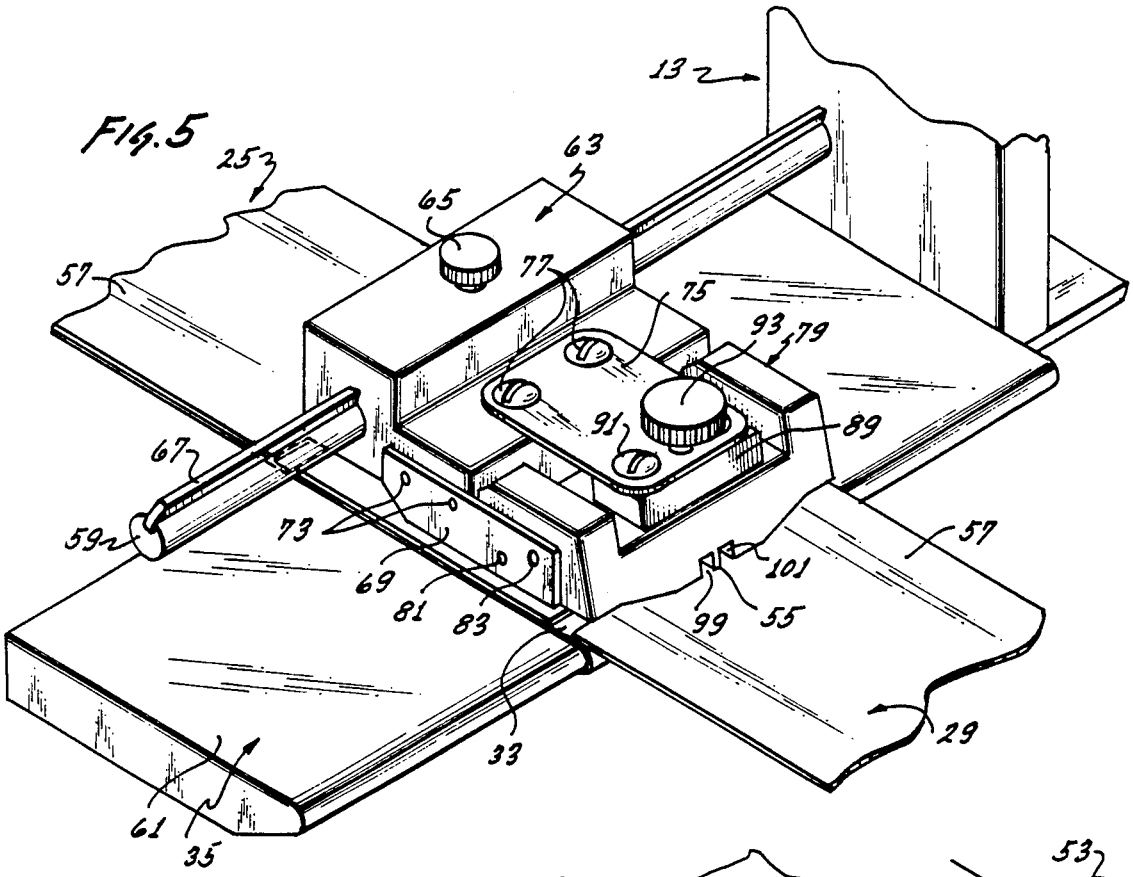
FIG. 5 is a fragmentary, isometric view of the peeler bar, sensing block, label strip and various mounting structure.

A preferred implementation of the basic concept shown in FIGS. 6 and 6*a* is illustrated in FIGS. 2–5. As best shown in FIG. 5, the peeler bar 19 and a shaft 59 are mounted on, and project from, the supporting structure 13, with the peeler bar 19 having a label strip supporting surface 61 which is generally planar. A mounting block 63 is mounted for sliding movement along the shaft 59 and can be fixed in position along the shaft by a screw 65. A spline 67 on the shaft engages a keyway in a bore of the mounting block 63 to prevent rotation of the mounting block about the shaft.

A pair of identical arms 69 and 71 are rigidly mounted on the opposite sides of the mounting block 63 by threaded fasteners 73, and a leaf spring 75 is attached to an upper surface of the mounting block by screws 77 so that the spring 75 is cantilevered from the mounting block. A sensing block 79 is mounted on the arms 69 and 71 for limited movement by pins 81 and 83 toward and away from the label strip 25. This can be accomplished, for example, by having the pins 81 and 83 be received in a vertical slot 85 (FIG. 4) and an oversized bore 87, respectively.

The leaf spring 75 biases the sensing block 79 toward the surface 61 of the peeler bar 19. Specifically, a block 89 is attached to the free end of the spring 75 by screws 91, and an adjusting screw 93 is threaded through the block 89 and into engagement with an upper surface 95 of the sensing block 79.

The sensing block 79 has a face 97 (FIGS. 2 and 2*a*) which confronts the label strip 25 and the surface 61 of the peeler bar 19. The sensing block 79 also has a recess opening at the face 97, and the barrier wall 55 is carried by the sensing block and divides the recess into chambers 99 and 101. Each of the chambers 99 and 101 is closed at its back end by a back wall 102 and is open at the opposite or forward end. The barrier wall 55 extends from the back wall 102 forwardly and terminates essentially flush with a forward face 104 (FIG. 2*a*) of the sensing block 79. All of the walls defining the chambers 99 and 101 are preferably dull black in color for maximum light absorbance.

Figure 2A:
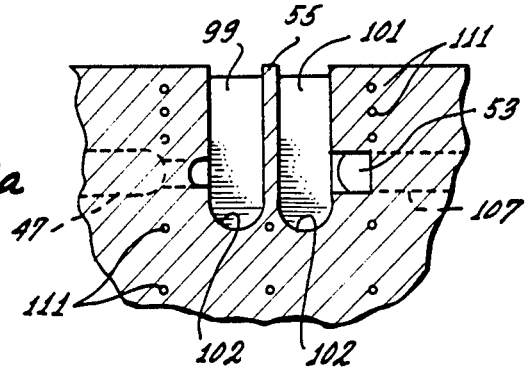
FIG. 2*a* is a fragmentary view taken generally along line 2*a*—2*a* of FIG. 2.
Figure 2:
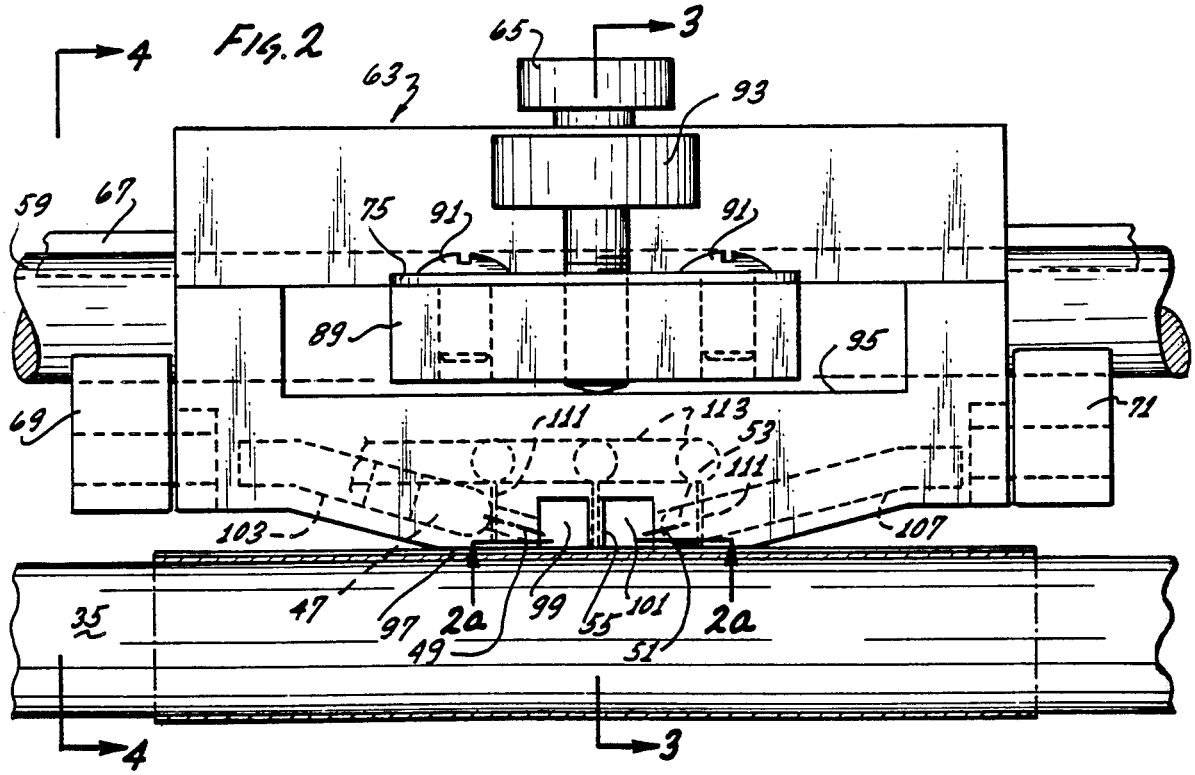
FIG. 2 is a front, elevational view taken generally along line 2—2 of FIG. 1.
Figure 3:
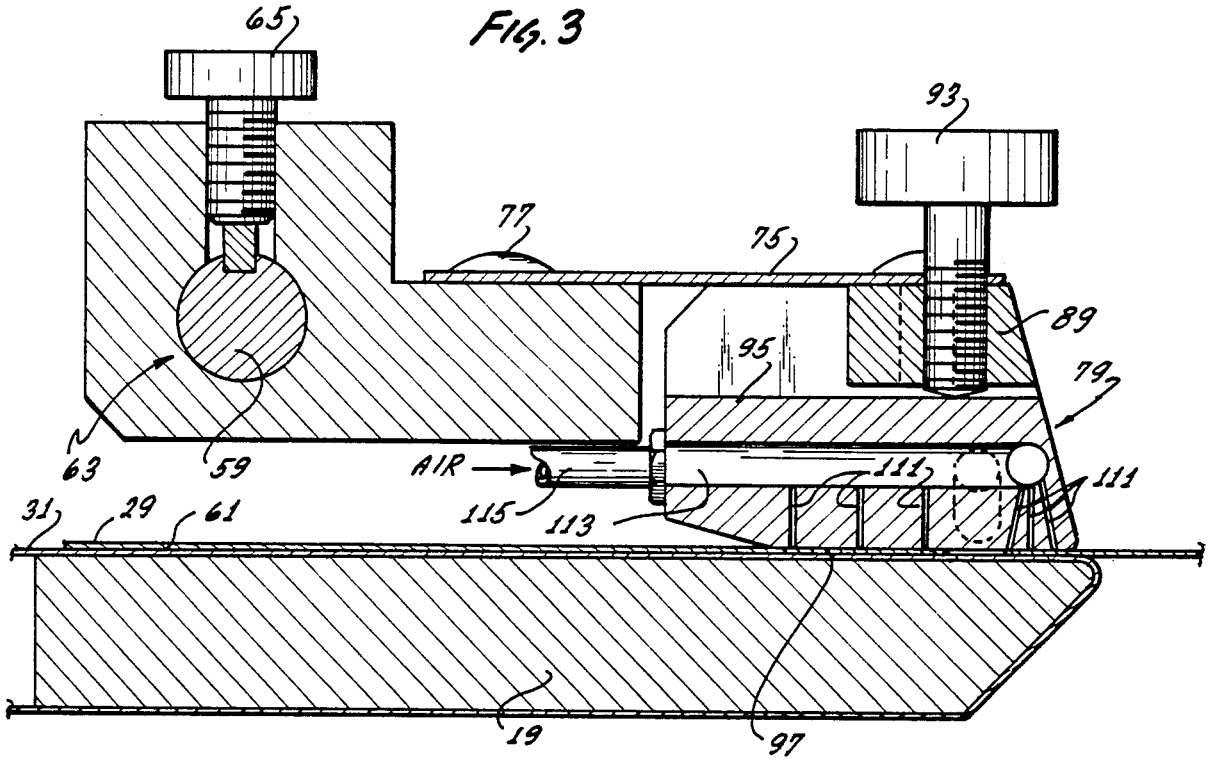
FIGS. 3 and 4 are views taken generally along lines 3—3 and 4—4, respectively, of FIG. 2.
Figure 4:
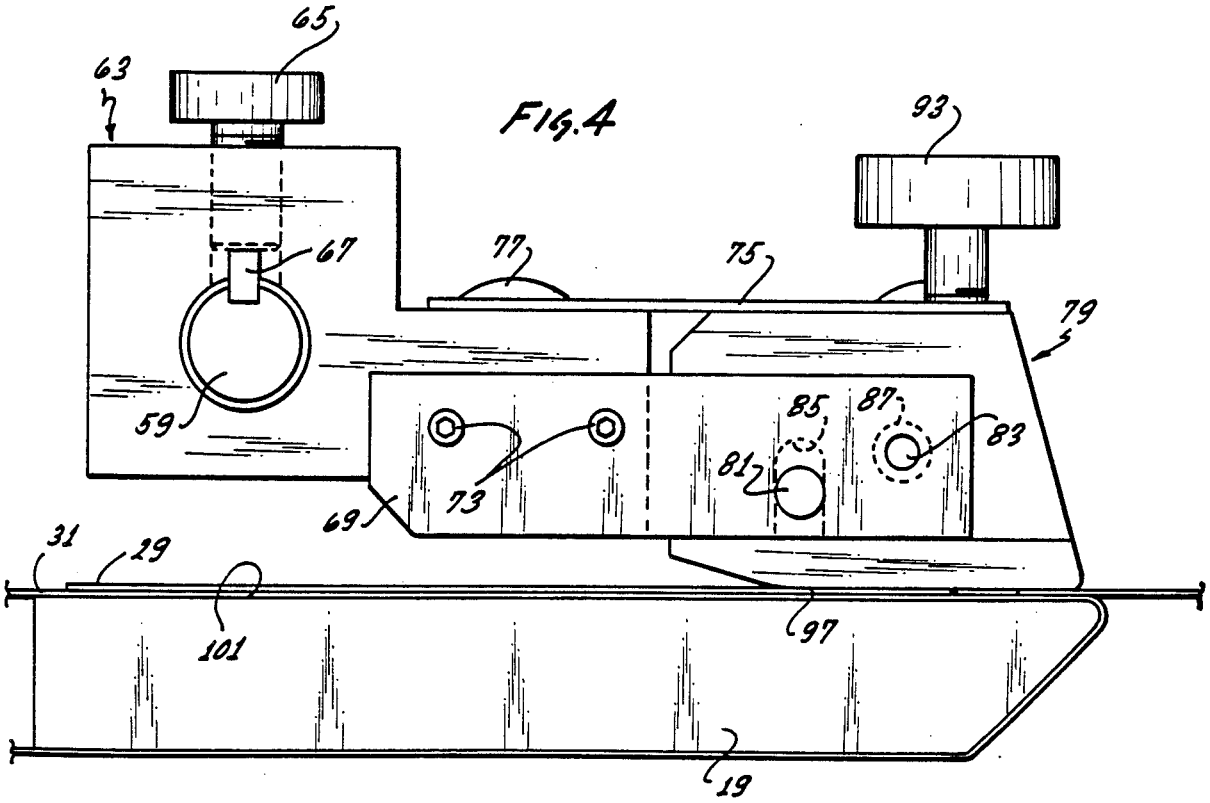

The sensing block has a source passage 103 which contains the light source 47 and a receiving passage 107 in which the light detector 53, which may be a photocell 53, is mounted. The source passage 103 leads to the chamber 99 to thereby direct light from the source 47 along the axis 49 into the chamber 99, and the receiving passage 107 extends from the chamber 101 to conduct light along the axis 51 from this chamber to the detector 53. As shown in FIG. 2*a*, the source passage 103 and the receiving passage 107 are both located intermediate to the back walls 102 and the open forward ends of the chambers 99 and 101. Of course, the light source 47 and the detector 53 may be located remotely with respect to the sensing block 79, and the light can be conducted to and from these elements in various different ways, such as with the use of fiber optics. The passages 103 and 107 may also contain the necessary conductors for the light source 47 and the detector 53.

The passages 103 and 107 open into the walls of their associated chambers 99 and 101 which are remote from the barrier wall 55. The angle of incidence A (FIG. 6) is preferably sufficiently small so that it will provide a reflected optical signal along the axis 51 of adequate intensity even when the web 31 is transparent. For example, the angle A may be about 15 degrees, although this is not critical.

As an option, the sensing block 79 may also have a series of air passages 111 which open at ports in the face 97. The sensing block 79 also has distribution passages 113 (FIGS. 2 and 3) coupled to an external conduit 115 for delivering air under pressure to the air passages 111 via the distribution passages 113.

The face 97 is a hard, flat, planar surface containing a dry lubricant to provide a very low coefficient of friction. The air under pressure exiting from the air passages 111 forms a thin lubricant film which separates the face 97 from the outer faces 57 of the labels 29; however, this separation is too small to permit light leakage from the chamber 99 to the chamber 101 when no gap 33 is present at the sensing station.

The operation of the label applicator 11 and of the sensing apparatus 35 is described above with reference to FIGS. 1, 6 and 6*a*. However, it should be noted that the lengths of the barrier wall 55 and of the chambers 99 and 101 are much greater than the width dimension of the gap 33 (FIGS. 6 and 6*a*). Also, the axes 49 and 51 are recessed substantially from the open ends of the chambers 99 and 101. Accordingly, the barrier wall 55 readily spans the gap 33, and sensing takes place at a location remote from the open forward ends of the chambers 99 and 101 so that only minimal ambient light is present.

The angle of incidence "A" (FIG. 6) must be sufficiently small so that light directed along the axis 49 can be reflected across or beneath the barrier 55 to the detector 53. In addition, if the web 31 is transparent, the angle of incidence "A" must be sufficiently small so that an optical signal will be reflected to the detector 53.

Figure 7:
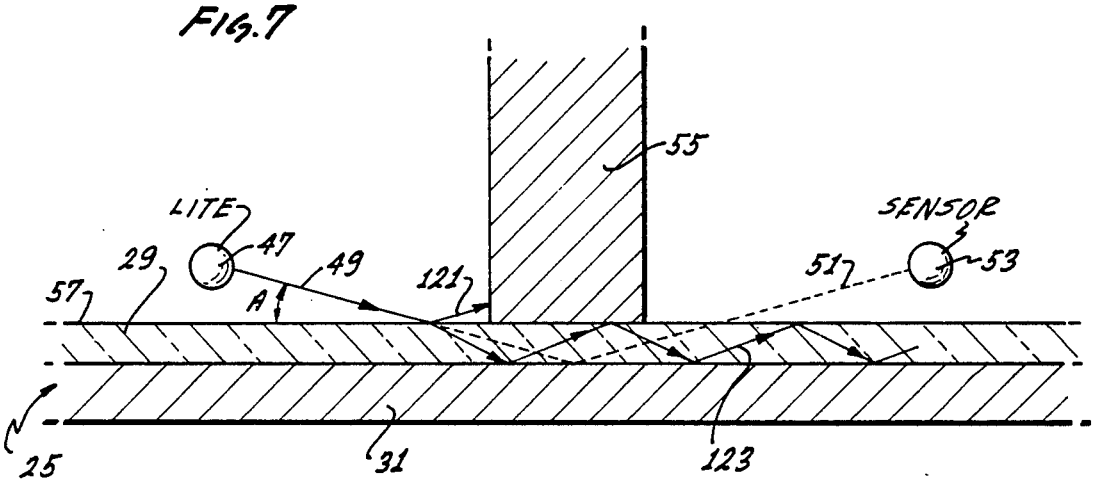
FIG. 7 is a somewhat schematic sectional view illustrating how light entering a transparent label can be captured by total internal reflection.

FIG. 7 illustrates by way of example how light from the source 47 can be captured by total internal reflection when the label 29 is transparent if the angle of incidence "A" is sufficiently small. This is based upon the known principle that, when light propagates from a dense medium, such as the label 29, to a less dense medium, such as air, it is possible for the light to be totally reflected. One example of this is fiber optics in which the light in the glass fiber is reflected back into the fiber and is essentially captured by the glass. The phenomena of total internal reflection occurs when the angle of incidence "A" is smaller than a critical angle.

With reference to FIG. 7, light from the source 47 is directed along the axis 49 and some of it is reflected from the upper surface 57 of the label 29 into the barrier 55 as indicated by an arrow 121. The remaining portion of the light enters the transparent label 29 and is essentially totally reflected along a line 123 between the upper and lower surfaces of the label, with substantially none of the light being able to penetrate the upper surface of the label and pass to the detector 53. If the angle of incidence "A" were increased to be larger than the critical angle, some light could pass through the transparent label 29 and reach the detector 53. The critical angle is different for different materials. In this embodiment, the angle "A" is 15 degrees, and this is below the critical angle for the label 29 so that total internal reflection is obtained.

Figure 8:
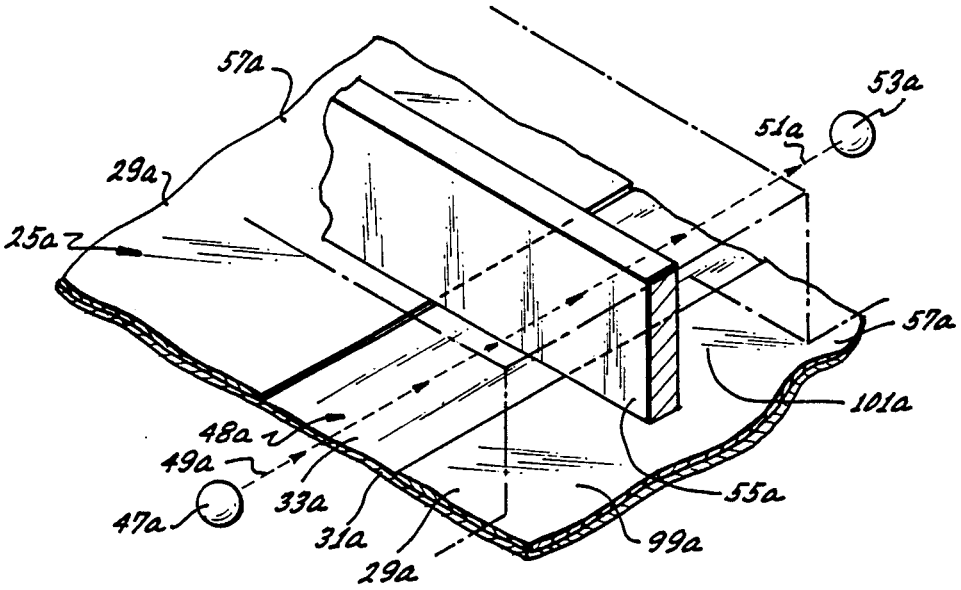
FIG. 8 is a view similar to FIG. 6 illustrating a second embodiment of the invention.

FIG. 8 shows a second embodiment of the invention which may be substantially identical to the embodiment of FIGS. 1–7, except to the extent shown or described herein. Portions of the embodiment of FIG. 8 corresponding to portions of the embodiment of FIGS. 1–7 are designated by corresponding reference numerals followed by the letter "a."

The primary difference between the two embodiments is that, in the embodiment of FIG. 8, the source 47*a* and the gap 33*a* are in approximate alignment when the gap is at the sensing station 48*a*. Accordingly, the axes 49*a* and 51*a* are essentially coincident so that the optical signal can be transmitted through the gap 33*a*, with the light extending along the axes 49*a* and 51*a* being generally parallel to the gap 33*a*. When no gap is present at the sensing station 48*a*, the light from the source 47*a* is essentially blocked by the label 29*a* and the barrier 55*a*. Even if the label 29*a* is transparent, enough light would be lost in the transmission from one edge of the label to a location on the far side of the barrier 55*a* so that there would be a distinct difference in intensity between any such light reaching the detector 53*a* and the light reaching the detector 53*a* when one of the gaps 33*a* were present at the sensing station 48*a*.

The concept of the embodiment of FIG. 8 can be implemented in substantially the same way as the embodiment of FIGS. 1–7. In this regard, all that is necessary is to have the passages 103 and 107 positioned so that the light can travel along the axes 49*a* and 51*a* as shown in FIG. 8.

Although an exemplary embodiment of the invention has been shown and described, many changes, modifications and substitutions may be made by one having ordinary skill in the art without necessarily departing from the spirit and scope of this invention.

I claim:

1. A labeling method comprising:

providing a label strip which includes an elongated essentially transparent web and a plurality of essentially transparent labels with the labels being on the elongated web and with adjacent labels being separated by a gap;

moving the label strip through a label sensing station;

placing a light barrier across the gap and over portions of the labels on opposite sides of the gap at the sensing station;

directing light from a source toward said label strip from one side of the barrier at the label sensing station so that the light is directed sequentially toward said labels and said web at said gaps;

said step of directing including directing the light against the label strip at an acute angle of incidence which is sufficiently small so that an optical signal is reflected from the web in the gap at the sensing station to the other side of the barrier and any portion of the light from the source which enters a transparent label when light is directed toward such label from the source is essentially captured by substantially total internal reflection within such transparent label;

detecting the optical signal on said other side of the barrier with a detector to thereby detect the presence of the gap at the sensing station; and removing the labels from the web and applying them to articles.

2. A method as defined in claim 1 including providing a sensing block having a face which confronts the label at the sensing station with the face having a recess therein, said step of directing includes directing light into the recess and against the web in the gap at the sensing station at an acute angle of incidence so that the optical signal is reflected from the web into the recess.

3. A label applicator for use with a label strip which includes an elongated web and a plurality of labels with the labels being on the elongated web and with adjacent labels being separated by a gap, said apparatus comprising:

means for moving the label strip through a label-sensing station;

means for removing the labels from the web and transferring them to articles;

means for directing light toward the label strip at the label-sensing station so that the light impinges sequentially on the labels and the web in the gap at the label-sensing station;

said directing means directing light against the label strip at an acute angle of incidence which is sufficiently small so that an optical signal can be reflected from the web in the gap at the sensing station;

detecting means for detecting the optical signal and responsive to the optical signal to provide a sensor signal;

barrier means cooperating with the labels to reduce light other than said optical signal from being conducted from the directing means to the detecting means whereby the presence of said gap at the sensing station is known;

means responsive to the sensor signal for stopping the movement of the label strip by the moving means, and at least some of said labels being at least somewhat transparent and said angle of incidence being sufficiently small so that any portion of the light from said directing means which enters a transparent label when the light impinges on such transparent label outside the gap is essentially captured by substantially total internal reflection within said transparent label whereby such entering light is substantially precluded from passing to the detecting means.

4. An apparatus as defined in claim 3 wherein said barrier means includes a light barrier extending across the gap at the sensing station and the directing means directs the light between the barrier and the web at the gap at the sensing station.

5. An apparatus as defined in claim 3 including a sensing block having a face and means for mounting the sensing block so that the face confronts the labels at the sensing station, said face having a recess therein opening at said face, said barrier means includes a barrier wall carried by said sensing block and dividing said recess into first and second chambers, said directing means directs light into the first chamber and said second chamber receives the optical signal, said detecting means being in optical communication with said second chamber.

6. An apparatus as defined in claim 5 including conduit means including passages in said sensing block and ports in said face for conducting air under pressure to said face.

7. An apparatus as defined in claim 5 wherein said sensing block mounting means includes means for resiliently resisting movement of the sensing block away from the labels.

8. An apparatus as defined in claim 5 including means including a peeler bar for removing the labels from the web and means for transferring the removed labels to articles and said sensing block mounting means mounts the sensing block closely adjacent the peeler bar so that the label strip passes between the peeler bar and the sensing block.

* * * * *